United States Patent [19]

Martin

[11] 4,090,063

[45] May 16, 1978

[54] FRANKING MACHINE COMPRISING AN ELECTRONIC COUNTING SYSTEM

[75] Inventor: Claude Raymond Martin, Saint Germain en Laye, France

[73] Assignee: Societe d'Etude et de Construction d'Appareils de Precision (S.E.C.A.P.), Asnieres, France

[21] Appl. No.: 746,712

[22] Filed: Dec. 2, 1976

[30] Foreign Application Priority Data

Dec. 11, 1975 France ..... 75 37911

[51] Int. Cl.[2] ..... G06M 3/08; G06M 1/274; G07B 17/02

[52] U.S. Cl. ..... 235/92 AC; 101/91; 235/92 MP; 235/92 ST; 235/92 R; 235/101

[58] Field of Search ..... 101/91, 92; 235/92 AC, 235/92 CC, 92 MP, 92 C, 92 ST, 92 CT, 92 EA, 92 SH, 101

[56] References Cited

U.S. PATENT DOCUMENTS

| | | | |
|---|---|---|---|
| 2,676,756 | 4/1954 | Gulley | 235/92 EA |
| 3,169,185 | 2/1965 | Nines | 235/92 DM |
| 3,428,948 | 2/1969 | Simjian | 235/101 |
| 3,436,530 | 4/1969 | Faude et al. | 235/92 AC |
| 3,624,362 | 11/1971 | Kelch | 235/92 C |
| 3,770,945 | 11/1973 | Dlugos et al. | 235/92 EA |
| 3,890,491 | 6/1975 | Malauazos et al. | 235/101 |

*Primary Examiner*—Joseph M. Thesz
*Attorney, Agent, or Firm*—McDougall, Hersh & Scott

[57] ABSTRACT

A mail franking machine comprises a totalizing device having electronic means for recording at least a predetermined number of lower-order digits of the total printed franking values. An electronic recording counter receives values to be recorded from a decade counter the stages of which are set by a shift register and pulse generator under the control of an order counter and a synchronizing circuit actuated by a pulse transmitter connected to a printing drum of the machine. The shift register receives signals in succession from sensing elements selectively actuated during rotation of the printing drum in dependence upon the set positions of adjustable printing wheels on the drum.

5 Claims, 9 Drawing Figures

FRANKING MACHINE COMPRISING AN ELECTRONIC COUNTING SYSTEM

BACKGROUND OF THE INVENTION

The invention relates to mail franking machines comprising printing wheels set to a selected franking value by a manually operated mechanism and means for totalizing the franking values and recording the total of such values.

In general, a franking machine mainly comprises a postal franking stamp-printing device comprising printing wheels and one or more totalizing counters for adding or substracting franking values. In the prior art, these two parts of the machine are of mechanical construction, the counters inter alia comprising gear systems and various mechanical components acting as a totalizer.

Mechanical counters have a number of disadvantages, inter alia: the complexity and cost of the mechanical components and the required tools; the fact that the components are not incorporated in standard units, so that the machines are difficult to adapt for different postal systems; and the inertia and fatigue rate of the components, which limits the speed attainable by the machine.

The invention aims to extend the possibilities of franking-machines, simplify their manufacture, reduce their dimensions and maintenance and enable them to operate at higher speeds.

SUMMARY OF THE INVENTION

To this end, in a franking machine according to the invention, the totalizing counter includes electronic means for recording at least a predetermined number of lower-order digits of the total of the franking values.

Thus, if the totalizing counter is completely electronic, all the aforementioned disadvantages of mechanical counters are completely eliminated.

Although desirable for the reasons given, the solution of a completely electronic totalizing counter cannot be adopted unless the proposed electronic circuits ensure the same reliable counting as mechanical systems. For this reason, according to another feature of the invention, the electronic circuits of the totalizing counters are based on integrated circuits having very low power consumption, e.g. circuits known in the prior art under the name "COS-MOS technology" using complementary field-effect transistors and constructed by the metal-silicon oxide process, or similar circuits. Such circuits have practically zero current consumption in the absence of logic signals, and it is therefore possible to construct stores which retain information for several years provided they are energized by a battery or similar electric generator which can have a very low capacity.

In order substantially to eliminate disputes resulting from fraudulent attempts at erasure of the stored values, the invention provides a particularly efficient feature: namely, instead of constructing a completely electronic totalizing counter assembly, electronic totalizing counters can be provided for the lowest-weight decades corresponding to maximum values of the introduced data, and the higher-order decades can be recorded by an electromechanical counter comprising digit-bearing wheels driven by a step-by-step motor via suitable step-down gearwheels, in accordance with a well-known technique. This feature combines the previously-enumerated advantages of electronic counting with improved preservation of the recorded amounts in the event of damage.

The invention will be more clearly understood from the following description and the accompanying drawings, which show an embodiment of a franking machine according to the invention. In the drawings:

DESCRIPTION OF THE PREFERRED EMBODIMENTS

Figures 1, 2, 3:
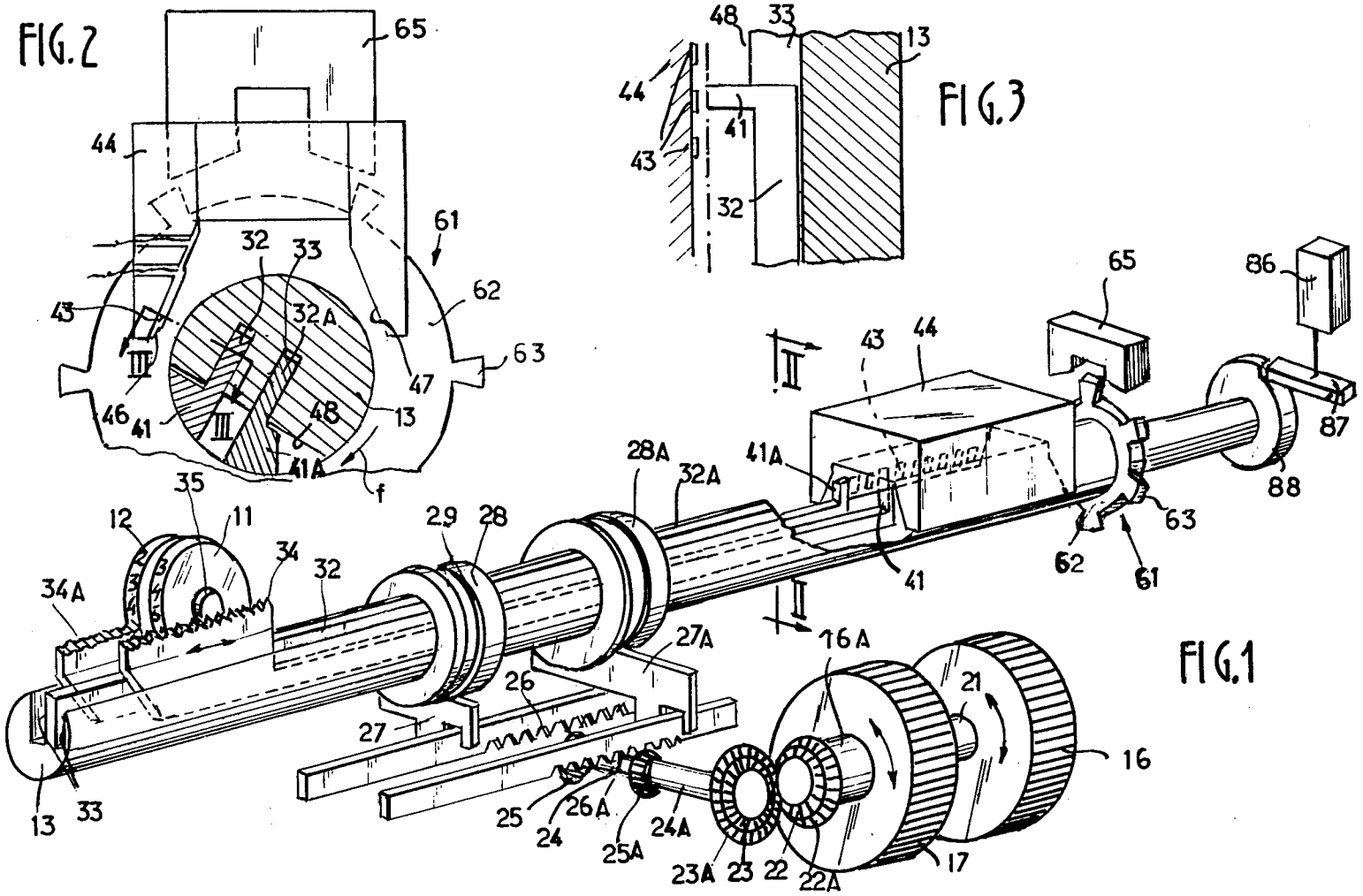
FIG. 1 is a perspective view of the basic components of a franking machine according to the invention; for simplicity, it is assumed that the printing drum contains only the characters for printing units and tens.
FIG. 2 is a larger-scale cross-section along line II—II of FIG. 1.
FIG. 3 is a partial cross-section along line III—III in FIG. 2.

FIG. 1 shows part of a franking machine which, like all prior-art franking machines, comprises a printing drum bearing stationary printing elements and variable printing elements, all engraved in relief. Among the variable printing elements, the drawing shows only a wheel 11 for printing the unit digits of the franking values and a wheel 12 for printing the tens digits. Of course, the machine has a larger number of wheels, used for printing higher-order recorded digits. The wheels are rotatably mounted in a drum which is not shown, but is secured to a shaft 13 in the machine which can rotate only in the direction of arrow *f*, owing to the presence of a pawl and ratchet-wheel device (not shown).

Two manually actuated wheels 16, 17 are used for adjusting the value of the two printing wheels 11, 12 respectively, via appropriate transmission systems.

The transmission system connecting wheel 16 to wheel 11 comprises a shaft 21 secured to wheel 16, a conical toothed gearwheel 22 secured to shaft 21, a conical gearwheel 23 engaging wheel 22 and secured to a shaft 24, a toothed wheel 25 secured to shaft 24, a rack 26 engaging gearwheel 25, a yoke 27 secured to rack 26, a ring 28 which can slide on shaft 13 and has an annular groove 29 in which yoke 27 engages, a rod 32 which can slide in a longitudinal groove 33 of shaft 13, a rack 34 secured to the sliding rod 32 and a toothed gearwheel 35 engaging rack 34 and secured to the printing wheel 11.

The transmission system connecting the value-setting wheel 17 to the printing wheel 12 is similar to the system which has just been described for setting wheel 11; the corresponding components are denoted by the same reference figures plus the index "A".

Rod 32 has a tooth 41 and, in similar manner, rod 32A has a tooth 41A (see also FIG. 3). Teeth 41, 41A are in line in the same plane, at an angle to shaft 13, when the same value is set up on wheels 11 and 12. Ten magnetoresistive cells 43 parallel to shaft 13 are disposed in a row and incorporated in a fixed common magnetic circuit 44 (FIGS. 1 and 2) extending over the entire length of the useful travel of the teeth such as 41. A flux passes constantly through magnetic circuit 44, which is e.g. a permanent magnet.

When the machine is inoperative, shaft 13 occupies the angular position shown in FIG. 2, in which neither of the teeth 41, 41A is opposite the magnetic circuit 44, and the cylindrical surface of shaft 13 is quite close to the polar surfaces 46, 47 of the magnetic circuit, so that the air gap has a minimum thickness and a maximum flux travels through all the magnetoresistive circuits, whereas during operation, when a flat portion 48 in shaft 13 in the region where rods 32, 32A slide comes opposite the polar surface 46 of magnetic circuit 44, the magnetic flux is greatly reduced by the increased width of the air gap, except in the cell which is opposite the current position of tooth 41 or tooth 41A.

Magnetoresistive cells have the property of having an electric resistance which varies in dependence on the magnetic flux to which they are subjected. Consequently the cell opposite a tooth shows a variation in resistance which produces a variation in the characteristics of an associated individual electric circuit, thus producing a signal for use in the electronic circuit. Thus, each sliding rod 32 or 32A, during the rotation of shaft 13, alternately actuates one of the ten cells, so that the values set up and printed by wheels 11, 12, etc. are supplied to the electronic circuits.

Figure 4:
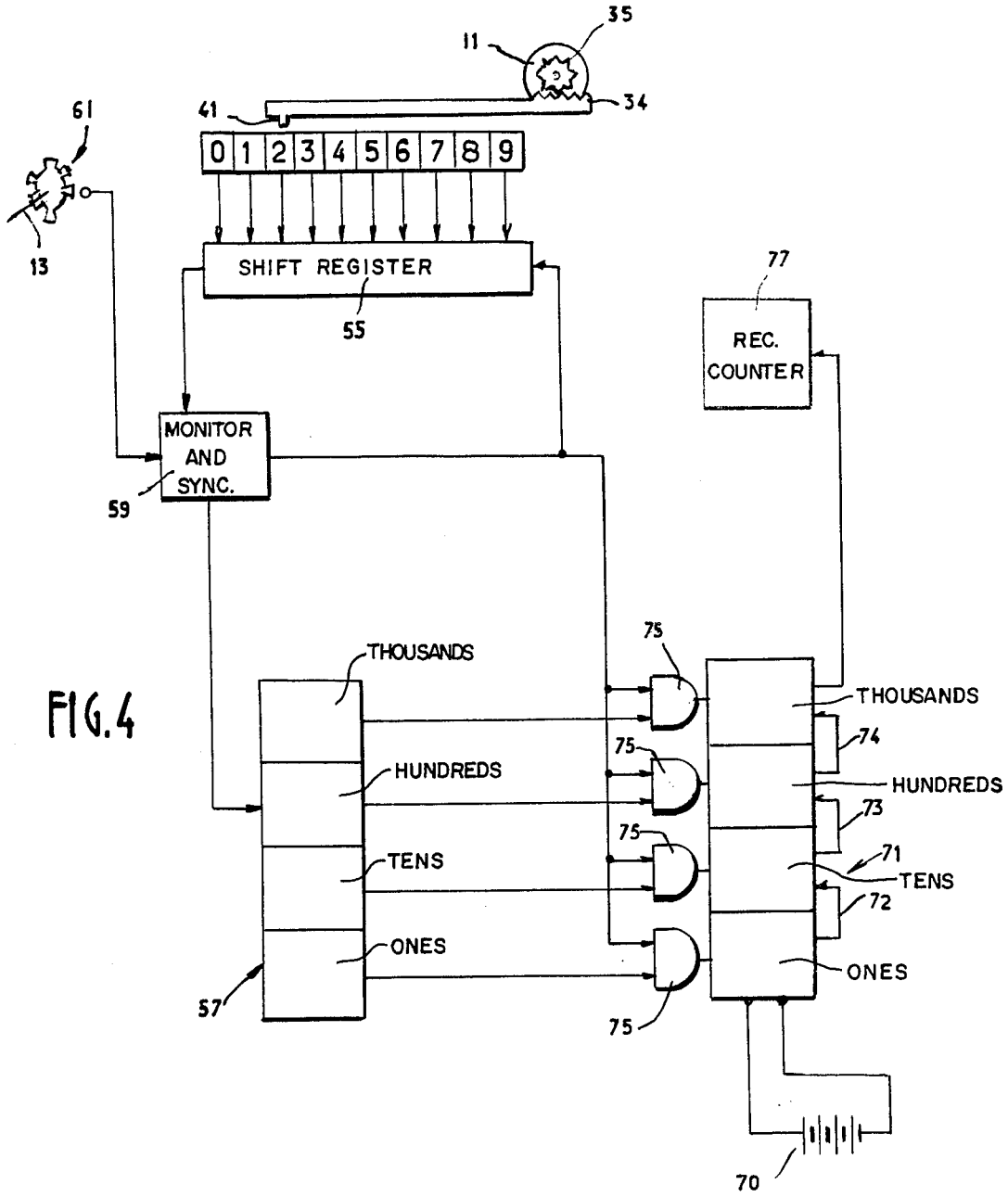
FIG. 4 is a diagram of the electronic circuits of the machine.

As shown in FIG. 4, the electronic circuits comprise: a shift register 55 having parallel inputs connected to the magnetoresistive cells 43 and a ten-bit series output; an order counter 57, e.g. having four positions denoted in the drawing by U, D, C, M respectively and corresponding to units, tens, hundreds and thousands respectively; a set of monitoring and sync circuits 59 connected to the shift register 55 and the order counter 57 and controlled by a pulse transmitter 61 (see also FIGS. 1 and 2) comprising a wheel 62 having teeth 63 secured to a shaft 13 and cooperating with the limbs of a stationary permanent magnet 65 so as to determine the successive passes of the sliding rods such as 41 in front of the row of magnetoresistive cells 43; a set of decades for units, tens, hundreds, etc., bearing the general reference 71 and having counting inputs and carry-over outputs 72, 73, 74 connected to the next higher-order decade, each counting decade being connected, via an AND gate 75 in parallel with the input of shift register 55. Each AND gate has a second input which is connected to the corresponding units, tens, hundreds or thousands output of the order counter 57; the output of the highest-order or M counting decade of the set of decades 71 is connected to the input of an electronic recording counter 77 having e.g. eight digits.

The device operates as follows:

The printing wheels 11, 12 are set at a selected value, using the manually actuated wheels 16, 17. In order to frank an article of mail, the printing drum borne by shaft 13 is turned through a complete revolution. During the revolution, when the first sliding rod, e.g. 32, passes in front of the ten-position pick-up comprising the row of ten magnetoresistive cells 43, the pulse transmitter 61, via circuits 59, actuates the order counter 57 in the units position, and the ten information bits available at the cells are introduced into register 55. The register is thus loaded with nine "zeros" and one "one", corresponding to the magnetoresistive cell opposite tooth 41. The number of shift instructions required for the "one" bit to appear on the last cell (series output) is equal to the value set up on the printing wheel.

Immediately afterwards, the actuating circuits 59 actuate the shift control of register 55 until the "one" bit appears at its last cell, thus producing a number of pulses equal to the value set up on the printing wheel. The corresponding AND gate (75U), which is enabled by the order counter 57, conveys the pulses to the "U" (units) decade 71, which records them by adding them to the existing contents of the decade. If necessary, a carry is sent to the "D" (tens) decade and may in turn result in carries to higher-order decades. These operations take about 1 millisecond, using a 10 kHz clock; they are substantially complete when the second sliding rod 32A comes into the counting position opposite the ten-cell pick-up. The same operations are then repeated in order to introduce the tens into the counter, with the single difference that the order counter is in the "tens" position and conveys the pulses to the "tens" counter and so on, up to the highest order. Finally, the current franking value is added to the values previously recorded in the general counter 77.

Since shaft 13, which bears the printing drum, can rotate in only one direction and since the values are recorded in the counter during the complete revolution required for printing, it is impossible to print without recording and to record without printing.

In order to protect the machine against possible fraudulent operation, the essential counter components and the independent current source (preferably a supply battery) must be enclosed in the tamper-proof casing of the franking machine. Accordingly, the circuits must be made insensitive to external agents. They can easily be sheltered from electric and magnetic fields by adequate screening, and can be protected against excessive heat so as not to exceed the upper operating temperature of the electronic batteries and circuits.

In this manner, a franking machine can be equipped with a completely electronic current, in which case a device for displaying the counter contents must also be provided.

In order substantially to eliminate disputes in the event of attempted fraudulent erasure, it may be advisable, instead of constructing a completely electronic totalizing counter assembly, to provide electronic totalizing counters for the lower-order decades corresponding to maximum values of the introduced data, and to provide the higher-order decades with an electromechanical counter counting the digit-bearing wheels driven e.g. by a step-by-step motor via suitable step-down gearwheels, in accordance with a well-known method. This feature combines the previously-explained advantages of electronic counting with more reliable storage of the recorded amounts in the event of damage.

Figure 5:
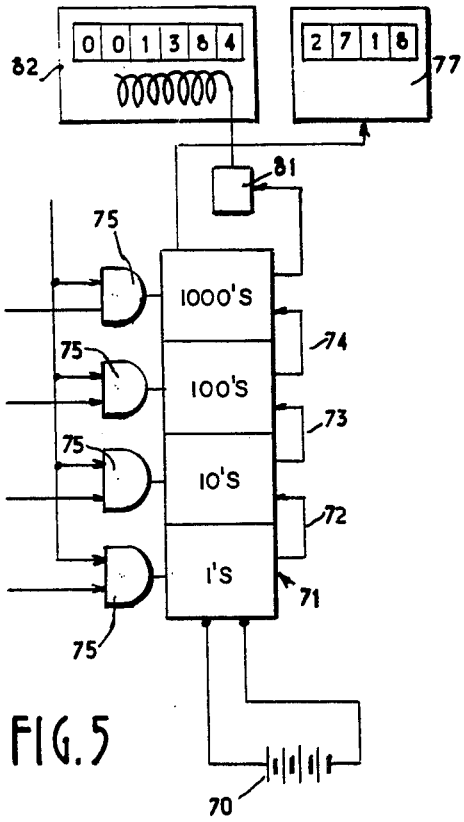
FIG. 5 is a diagram of the circuits in a variant machine equipped with a partially electronic counter and a partially electromechanical counter.

Thus, for example, in the case of a four-value machine which can frank up to 9999 monetary units, the four lower orders of the totalizing counter will be equipped with electronic decades and a carry from the fourth decade will actuate a six-digit electromechanical counter. In the event of damage or fraud, the dispute could never exceed 9999 monetary units, which is not a large amount compared with the total changes generally recorded by a franking machine. By way of example, this is represented in FIG. 5, which shows the set of decades 71 and the electronic recording counter 77, but the counter, instead of having eight digits as in the embodiment in FIG. 4, has only e.g. four digits. The carries delivered by the highest-order electronic decade, e.g. the thousands decade M in the example, are sent to a shaping circuit 81 which in turn sends a pulse of calibrated intensity and duration to an e.g. six-figure electromechanical counter 82 so that the latter moves forward by one step. Thus the total of the lower-order values, i.e. four in the example, is recorded in the electronic counter 77, which need not in the present case be provided with a means for displaying its contents, whereas the total higher-order values are recorded and displayed on the electromechanical counter 82.

The electronic counter 77 counts the four lower-order values from the decades 71, while the electromechanical counter 82 counts only the carries delivered by the highest order electronic decade M. In other words, the total is constituted by a number having a first portion (higher-order digits) which appears on the electromechanical counter 82 and a second portion (lower-order digits) which appears on the electronic counter 77.

Counter 82 can comprise wheels and carry gear-wheels actuated by a mechanism comprising a step-by-step motor. It may be of a completely different kind, e.g. using electromechanical pulses, in which case it can comprise an electromagnet which actuates a first counting wheel via an escape mechanism, the wheel being connected to other counting wheels by carry gear-wheels. In all cases, the number recorded in the counter is directly readable through a window where the figures engraved on the counter wheels appear.

Figure 7:
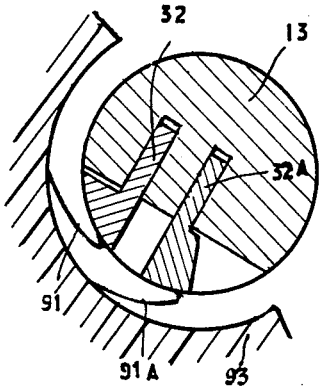
FIG. 6 is a perspective view and FIG. 7 is a corresponding cross-section of another embodiment of the printing character position pick-ups.
Figure 6:
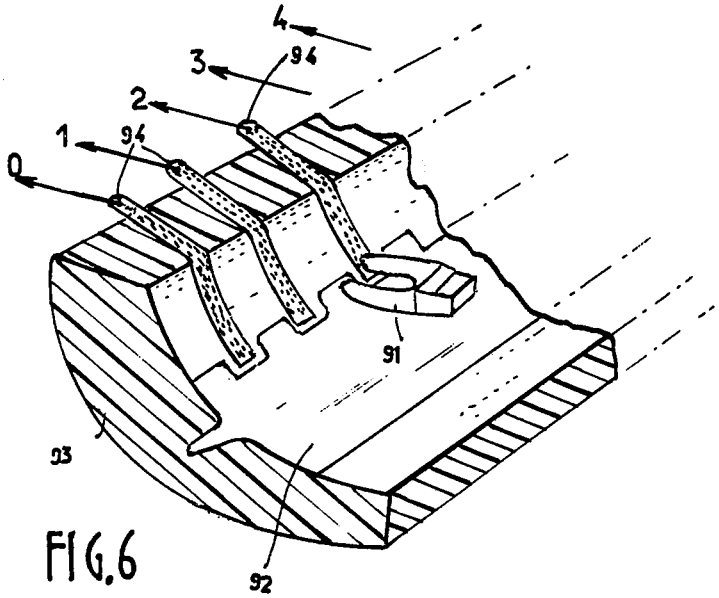

In the embodiment shown in FIGS. 1 to 3, the pick-ups sensing the position of each printing character are electromagnetic, but they could be of any other suitable kind, e.g. galvanic circuits as in the variant shown by way of example in FIGS. 6 and 7. Each sliding rod such as 32, connected to a printing wheel such as 11 (FIG. 1) bears a flexible contact brush 91 which performs a similar function to tooth 41 in the previously-described embodiment. By means of the brush, a common longitudinal conducting strip 92 connected to a suitable current source and secured in a stationary insulating support 93 disposed around shaft 13 is selectively connected to one out of a row of ten individual conductors 94 respectively connected to the corresponding inputs of the shift register 55 (FIG. 4).

The general operation of the assembly remains unchanged.

The machines which have been described with reference to FIGS. 4 and 5 comprise all the components of a mechanical franking machine and can of course be organized and constructed in the same manner, i.e. the printing device and associated control means, the position pick-ups 43 of the printing elements, the general electronic circuits 55, 57, 59, 61, the decade sets 71, the counters and an independent source of electric energy 70 for maintaining at least counter 71 permanently energized without the possibility of a cut-off, can be disposed in a single casing which cannot be tampered with by the user and is accessible only to authorized persons.

Figure 8:
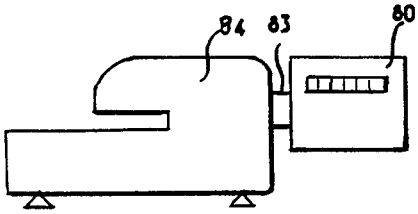
FIG. 8 shows a variant of the machine equipped with a detachable counter.
Figure 9:
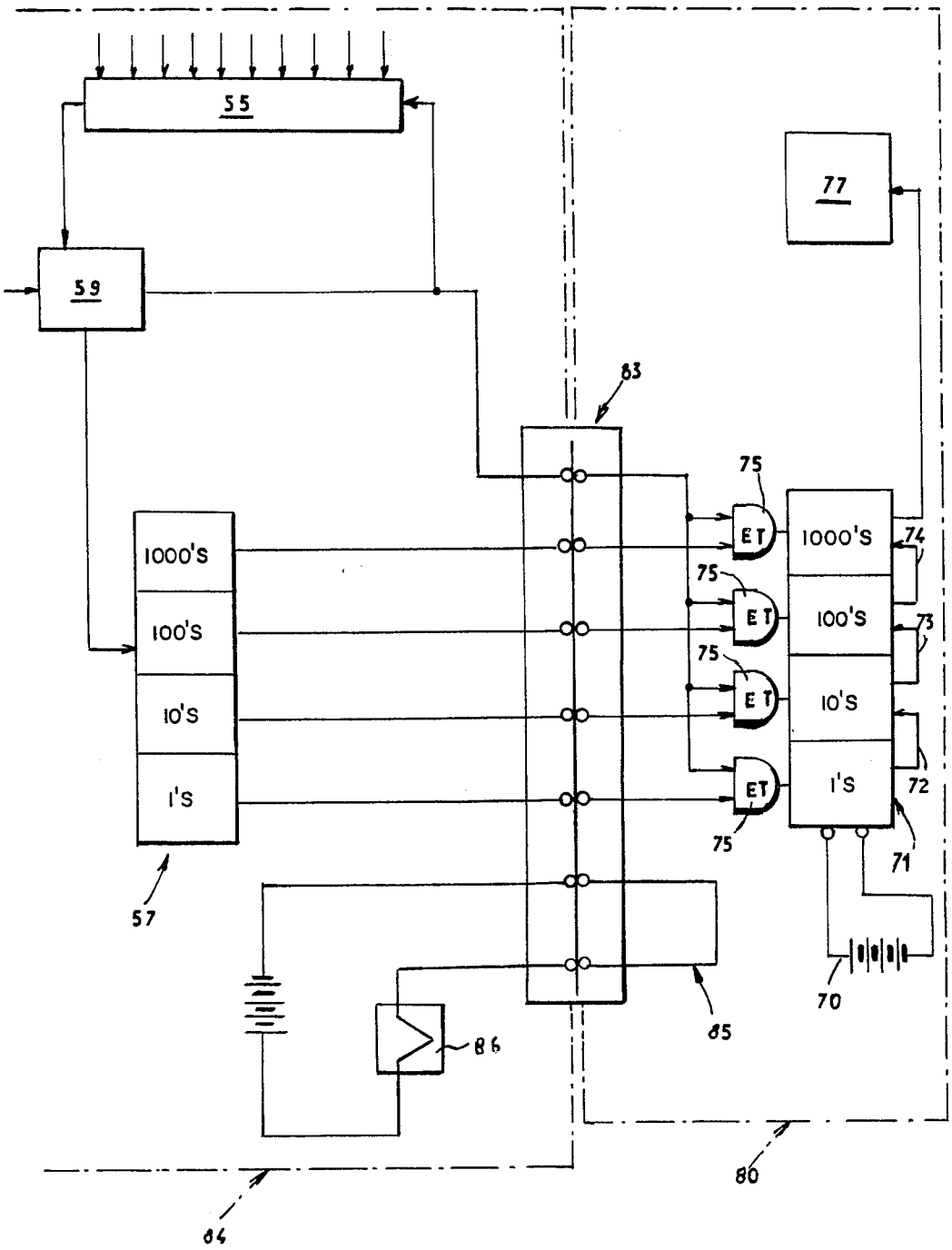
FIG. 9 shows part of the circuit of the variant shown in FIG. 8.

In a variant of the invention, the pick-ups 71, 77 and their independent energy source can be disposed in a tamper-proof removable sealed box 80 (FIGS. 8 and 9). The box comprises an electric connector 83 for connecting it to the main part 84 of the machine comprising the general electronic circuits 55, 57, 59 and 61, the printing device and the position pick-ups 43. Connector 83 comprises both the connections required for transmitting the digits to be recorded and a connection 85 which stops machine 84 from operating when box 80 is removed. To this end, the circuit of an electromagnet 86 (FIGS. 1 and 9) extends via connection 85. When the electromagnet is not energized, it releases a pawl 87 which prevents the rotation of a notched wheel 88 secured to shaft 13, so that the shaft is also locked. Of course, the invention is not limited to the embodiments described and shown but can be varied in numerous ways by the skilled addressee, depending on the intended applications, without thereby departing from its spirit.

For example, the electric circuits of the totalizing counters can be integrated circuits having very low power consumption, e.g. circuits known under the name "COS-MOS" using complementary field-effect transistors, the circuits being supplied by an incorporated battery or accumulator for a number of years. Alternatively, use can be made of store circuits not requiring permanent electric energization, e.g. circuits known under the name "NMOS" or "DIFMOS". In that case, the continuous electric source will be omitted.

I claim:

1. A mail franking machine comprising:

printing means including a rotatable printing drum, adjustable printing elements mounted on said drum operable to permit a selected franking value;

a manually operated mechanism connected to said printing elements for setting said printing elements to the selected franking value including value-adjusting elements each corresponding to a respective printing element and transmission elements connecting each value-adjusting element to the corresponding printing element;

means for totalizing the franking values and recording the total of such values, in which machine the improvement comprises: said totalizing means comprising electronic means for recording at least a predetermined number of lower-order digits of said total including pick-up means for sensing the positions of said transmission elements relative to the corresponding printing elements and delivering an electrical signal indicating said positions; electronic processing circuits connected to said pick-up means to produce from said electrical signal a further signal indicative of said franking value; and an electronic recording counter for recording said further signal, said pick-up means comprising a single row of ten sensing elements for selective and successive actuation of said transmission elements on each revolution of said printing drum;

said processing circuit including: a shift register having parallel inputs each connected to a respective one of said sensing elements and a ten-bit series output; a pulse generator having a controlled output for delivering a series of pulses equal in number to the value set on a printing element upon actuation of the sensing elements by the corresponding transmission element; a pulse transmitter on said printing drum having an output for indicating the rotational position of said drum; a synchronizing circuit having an input connected to said pulse transmitter output, said synchronizing circuit having an output; an order counter connected to said synchronizing circuit output for adopting a state synchronized with the rotation of said printing drum; and a decade counter having a plurality of stages each having a carry connection with the next higher-order stage, each stage having a counting input selectively connectible to said pulse generator output in dependence upon the state of said order counter; said recording counter being connected to said carry connection of the highest-order state of said decade counter.

2. A franking machine as claimed in claim 1, said electronic means comprising electronic recording devices for recording respective ones of said predetermined number of lower-order digits of said total, each said recording device having a carrying output; said machine further comprising: electromechanical means for recording the higher-order digits of said total; and means comprising a shaping circuit connecting the carry output of the highest-order electronic recording device to said electromechanical means to actuate said electromechanical means on delivery of a signal at said carry output of said highest-order electronic recording device.

3. A machine as claimed in claim 1, wherein said sensing elements comprise magnetoresistive cells; said pick-up means further comprising a permanent magnetic circuit having a stationary part, a rotary part rotatable with said printing drum, and an air gap between said stationary and rotary parts, said magnetoresistive cells being fixed to said stationary part in said air-gap, said transmission elements being mounted in said rotary part; each said transmission element having a tooth projecting into said air gap for actuating one of said magnetoresistive cells in dependence upon the value set on the corresponding printing element.

4. A machine as claimed in claim 1, wherein said sensing elements comprise individual electrically conductive elements; said pick-up means further comprising a stationary insulating support and a common conducting strip fixed to said insulating support, said conductive elements being separate from and spaced along said conducting strip; said transmission elements being rotatable with said printing drum and each having a brush for establishing a temporary electrical connection between one of said conducting elements and said common conducting strip in dependence upon the value set on the corresponding printing element.

5. A mail franking machine comprising:

printing means including a rotatable printing drum, adjustable printing elements mounted on said drum operable to permit a selected franking value;

a manually operated mechanism connected to said printing elements for setting said printing elements to the selected franking value including value-adjusting elements each corresponding to a respective printing element and transmission elements connecting each value-adjusting element to the corresponding printing element;

means for totalizing the franking values and recording the total of such values, in which machine the improvement comprises: said totalizing means comprising electronic means for recording at least a predetermined number of lower-order digits of said total including pick-up means for sensing the positions of said transmission elements relative to the corresponding printing elements and delivering an electrical signal indicating said positions; electronic processing circuits connected to said pick-up means to produce from said electrical signal a further signal indicative of said franking value; and an electronic recording counter for recording said further signal, said pick-up means comprising a single row of sensing elements for selective and successive activation by said transmission elements in the course of each revolution of said printing drum; said electronic processing circuits comprising a single decoding circuit adapted to receive said electrical signals; a pulse transmitter on said printing drum having an output for indicating the rotational position of said drum; a synchronizing circuit having an input connected to said pulse transmitter output, said synchronizing circuit having an output; an order counter connected to said synchronizing circuit output for adopting a state synchronized with the rotation of said printing drum to selectively control the ingress of said electrical signal into said single decoding circuit depending on the rotational position of said drum and to control said electronic recording counter.

* * * * *